US006701691B1

(12) United States Patent
Niiduma

(10) Patent No.: US 6,701,691 B1
(45) Date of Patent: Mar. 9, 2004

(54) DOME CONSTRUCTING METHOD

(75) Inventor: Yoshimi Niiduma, Tokyo (JP)

(73) Assignee: Housing Kousan Co, Ltd., Tokyo (JP)

( * ) Notice: Subject to any disclaimer, the term of this patent is extended or adjusted under 35 U.S.C. 154(b) by 0 days.

(21) Appl. No.: 09/807,769

(22) PCT Filed: Nov. 12, 1999

(86) PCT No.: PCT/JP99/06312

§ 371 (c)(1),
(2), (4) Date: Apr. 18, 2001

(87) PCT Pub. No.: WO00/29682

PCT Pub. Date: May 25, 2000

(30) Foreign Application Priority Data

Nov. 12, 1998 (JP) ..... 10-322492

(51) Int. Cl.[7] ..... E04G 17/04
(52) U.S. Cl. ..... 52/745.2; 52/81.3
(58) Field of Search ..... 52/81.1, 81.3, 52/745.2

(56) References Cited

U.S. PATENT DOCUMENTS

| | | | | | |
|---|---|---|---|---|---|
| 4,247,218 | A | * | 1/1981 | Jeanin | 403/217 |
| 4,260,276 | A | * | 4/1981 | Phillips | 403/169 |
| 4,319,853 | A | * | 3/1982 | Phillips | 403/172 |
| 4,370,073 | A | * | 1/1983 | Ohme | 403/172 |
| 4,379,649 | A | * | 4/1983 | Phillips | 403/172 |
| 4,395,154 | A | * | 7/1983 | Phillips et al. | 403/172 |
| 4,432,661 | A | * | 2/1984 | Phillips et al. | 403/172 |
| 4,442,059 | A | * | 4/1984 | Boyce | 263/228 |
| 4,449,843 | A | * | 5/1984 | Wendel | 403/173 |
| 4,464,073 | A | * | 8/1984 | Cherry | 403/170 |
| 4,491,437 | A | * | 1/1985 | Schwartz | 403/172 |
| 4,534,672 | A | * | 8/1985 | Christian, III | 403/172 |
| 4,566,818 | A | * | 1/1986 | Schwartz | 403/172 |
| 4,729,197 | A | * | 3/1988 | Miller | 52/81 |
| 5,165,207 | A | * | 11/1992 | Oehlke | 403/244 |

FOREIGN PATENT DOCUMENTS

| | | |
|---|---|---|
| JP | 5-39637 | 2/1993 |
| JP | 11-62003 | 3/1999 |

* cited by examiner

*Primary Examiner*—Carl D. Friedman
*Assistant Examiner*—Yvonne M. Horton
(74) *Attorney, Agent, or Firm*—Ladas & Parry

(57) ABSTRACT

A dome constructing method comprising the steps of assembling a triangular frame, which is the fundamental unit for a polyhedral skeleton, by using three joints and three frame members with the three joints used as the apexes and the three frame members used as the sides and with the triangular frame in contact with the ground, assembling new triangular frames around the ground-contacting triangular frame by using similar frame members and joints, thereby assembling the polyhedral skeleton of a multipyramid, such as pentagonal pyramid or hexagonal pyramid, with one joint that is positioned at one apex in the ground-contacting triangular frame being used as the apex and with the ground-contacting triangular frame used as one surface, wherein each time the polyhedral skeleton for the multipyramid is thus assembled, the same is turned to bring a new triangular frame other than the ground-contacting triangular frame into contact with the ground and then the assembling operation is repeated to assemble a polyhedral skeleton, thus constructing a spherical dome.

9 Claims, 10 Drawing Sheets

DOME CONSTRUCTING METHOD

TECHNICAL FIELD

This invention relates to a method for constructing a spherical dome, and more particularly to a dome constructing method which is enabled to construct a spherical dome, if relatively high, merely by using a relatively small-sized construction equipment and by assembling it at a relatively low position.

BACKGROUND ART

When a large-sized spherical dome is to be constructed, there may be adopted a method of constructing a polyhedron for a skeleton at first. For constructing this polyhedral skeleton, it is a general method of the prior art to construct a foundation on the land to be scheduled so that the polyhedron for the skeleton is sequentially assembled up on the foundation. As the spherical dome grows the larger (to have the highest point up to several tens meters in recent years), therefore, not only the construction equipment used for the dome construction becomes the larger but also the special works are required at the higher position.

When the works at the high position are increased in the spherical dome constructing method of the prior art, more specifically, large-sized construction equipments are required for building up the scaffold and for lifting and assembling the materials. On the other hand, special considerations have to be taken into the safety management of the workers at the high position. For this dome construction, great quantities and numbers of materials, labors and expenses are required to raise various problems in the drop of efficiency, in the rise of the construction cost and so on.

In order that the workers may go up to the their positions, for example, it is indispensable to construct a long scaffold, and it takes a sequentially longer time to lift the materials to be assembled. Thus, the spherical dome constructing method of the prior art have difficult problems to solve.

DISCLOSURE OF THE INVENTION

This invention relates to a dome constructing method for constructing a spherical dome by assembling a polyhedral skeleton and then by finishing the interior/exterior of the same, as will be specified in the following. Specifically, a plurality of joints, which are to be arranged when assembled at the positions of the individual vertexes of a polyhedral skeleton and each of which has a plurality of joint blades in the directions of the individual sides of the polyhedral skeleton, as extended from said individual vertexes, and a plurality of frame members are adopted as members for constructing the polyhedral skeleton of the spherical dome. Three joints and three frame members are assembled into a triangular frame or a basic unit of the polyhedral skeleton in a grounded state by using the three joints as the vertexes and the three frame members as the individual sides of the triangular frame. In addition, a new triangular frame is assembled around said grounded triangular frame by using similar frame members and joints, thereby to assemble the polyhedral skeleton of a polyhedral cone such as a pentahedral cone or a hexahedral cone, which uses the joints positioned at one vertex of said grounded triangular frame as its vertex and said grounded triangular frame as its one side. When the polyhedral skeleton of a polyhedral cone is thus assembled, a triangular frame different from said triangular frame is newly grounded by turning said polyhedral skeleton. The polyhedral skeleton is subsequently assembled by repeating similar assembling works, wherein the assembled polyhedral skeleton is fixed on the foundation, and the fixed polyhedral skeleton is then finished on its interior/exterior to complete the spherical dome.

According to this invention, more specifically, there is proposed a dome constructing method for constructing a spherical dome by assembling a polyhedral skeleton and then by finishing the interior/exterior of the same, which method comprises the following steps, by using a plurality of joints, which are to be arranged when assembled at the positions of the individual vertexes of a polyhedral skeleton and each of which has a plurality of joint blades in the directions of the individual sides of the polyhedral skeleton, as extended from said individual vertexes, and a plurality of frame members are adopted as members for constructing the polyhedral skeleton of the spherical dome, of steps:

(1) assembling a first triangular frame having three frame members as its sides in a grounded state with a side formed of said first triangular frame being in parallel with the ground surface, by using three joints as vertexes and three frame members to connect the two end sides of the three frame members to the adjoining ones of a plurality of joint blades in said three joints;

(2) assembling a polyhedral cone skeleton of a polyhedron, which has said one joint as its vertex and the number of the joint blades of said one joint as its side number, and which contains a side formed of said first triangular frame as its one side by connecting one-end sides of the remaining individual frame members to at least one of the three joints and connecting the joint blades of the remaining joints to the other end sides of each of said remaining frame members;

(3) assembling a polyhedral cone skeleton, which has said one joint of said grounded triangular frame as its vertex and the number of the joint blades of said one joint as its side number and which contains the side formed of said grounded triangular frame as its one side, by turning the polyhedral cone skeleton assembled at said step (2), to ground a triangular frame other than said first triangular frame so that a side formed thereof may be in parallel with the ground surface, by connecting one-end sides of the remaining individual frame members to at least one of the three joints positioned at the vertexes of said grounded triangular frame, and by connecting the joint blades of the remaining joints to the other end sides of each of said remaining frame members;

(4) assembling a polyhedral cone skeleton which has said one joint of said newly grounded triangular frame as its vertex and the number of the joint blades of said one joint as its side number and which contains the side formed of said newly grounded triangular frame as its one side, by turning the polyhedral skeleton assembled at said step (3), by grounding the triangular frame other than the said first triangular frame and the triangular frame grounded at said step (2), so that the side formed thereof may be in parallel with the ground surface, by connecting one-end sides of said remaining frame members to the individual joint blades of at least one of the three joints positioned at the vertexes of said newly grounded triangular frame, and by connecting the joint blades of said remaining joints to the other end sides of said remaining individual frame members;

(5) assembling the skeleton of the polyhedron which has a plurality of joints as its individual vertexes and a plurality of frame members as its individual sides, by repeating said step (4); and (6) completing the spherical dome by fixing the skeleton of the assembled polyhedron on the foundation and then by finishing the interior/exterior of the polyhedron.

In said method, the joint blades of the joint are four to six. If there are used a plurality of joints having four joint blades and a plurality of joints having six joint blades, for example, it is possible to construct a polyhedral skeleton having twenty four sides. If there are used joints (twelve) having five joint blades and joints (twenty) having six joint blades, it is possible to construct a polyhedral skeleton having sixty sides.

Here in said dome constructing method, after the polyhedral skeleton having a plurality of joints as its vertexes and a plurality of frame members as its sides was assembled, it can be placed in a hole, which has been excavated to have a depth of several underground floors in the scheduled land, and is fixed in the foundation. After this, the polyhedral skeleton can also be finished on its interior/exterior to complete the spherical dome.

After the polyhedral skeleton having a plurality of joints as its vertexes and a plurality of frame members as its sides was assembled, it is moved to the scheduled land, and reinforcing bars are laid over the grounded triangular frame. Concrete is placed over the reinforcing bars to construct the foundation of the dome. After this, the polyhedral skeleton can also be finished on its interior/exterior to complete the spherical dome.

According to the dome constructing method of this invention, the polyhedral skeleton for the spherical dome can be constructed at a relatively low position near the ground surface. It is sufficient to prepare the scaffold which has been used in the prior art for constructing an ordinary building having a two floors or the like. The works can be done at a relatively low position while retaining the safety of workers easily. On the other hand, the polyhedral skeleton for constructing the spherical dome is enabled to continue its assembling works by turning the polyhedral skeleton such as a pentahedral cone or a hexahedral cone, each time three joints and three frame members are used to assemble a triangular frame having the three joints as its vertexes and the three frame members as its sides sequentially thereby to assemble the polyhedral skeleton. If one set of movable scaffold is prepared, therefore, it is economically possible to move the scaffold for the continuous use.

According to the dome constructing method of this invention, all the polyhedral skeletons for the skeleton of the dome can be assembled at a position near the ground. For the dome construction, therefore, the large-sized construction equipments, as might otherwise be necessary in the prior art, can be eliminated, and a relatively low scaffold is sufficient. On the other hand, main works can be done at the low position so that the dome construction can be made highly efficiently in all the works including the lifting of the materials (e.g., the joints or the frame members) for constructing the polyhedral skeleton. Thus, it is possible to reduce the labors in the spherical dome construction thereby to shorten the construction period and lower the construction cost.

According to the dome constructing method of this invention, the fundamental unit of the polyhedral skeleton for the spherical dome construction is the triangular frame having the three joints as its vertexes and the three frame members as its individual sides. Therefore, the polyhedral skeleton is remarkably strong even in its partially completed state so that it is hardly deformed in its assembling procedure while hardly requiring a remedy of the shape of the polyhedral skeleton being assembled.

On the other hand, the polyhedral skeleton, as assembled for the dome construction, is the polyhedron having sixty sides and so on and is spherical so that it is balanced in the stress at the individual portions. Even if an external force is partially applied, it is rationally dispersed. Therefore, the stress is hardly concentrated locally to break the polyhedral skeleton.

The polyhedral skeleton to be formed by assembling the triangular frames of said basic unit sequentially is a quadrangular pyramid, a pentahedral cone or a hexahedral cone having the joints as its vertexes, as determined by the number of the joint blades belonging to the joints. The angles, at which the joint blades are attached to the joints, are determined by the directions of the individual sides of the polyhedron, as extending from the vertexes of the polyhedral skeleton using said joints.

These joints can be highly precisely manufactured by casting to the sizes which have been determined by the design. The joints can also be manufactured by welding the joint blades at predetermined angles to a cylindrical body.

On the other hand, the frame members to construct the individual sides of the triangular frame or said basic unit can be manufactured in advance to a high sizing precision because the sides of the polyhedral skeleton scheduled to construct the quadrangular pyramid, the pentahedral cone or the hexahedral cone have known lengths. These frame members are made of iron pipes, pipes or frames extrusion-molded of aluminum, or timber.

The joints of the frame members to the joint blades of the joint can be done merely by jointing the end portion sides of the frame members, which have been highly precisely made in advance, to the joint blades having a predetermined angle. Therefore, the joints can be done simply and extremely highly precisely not by the skilled workers.

Specifically, the construction of the polyhedral skeleton for the spherical dome construction in the dome constructing method of the present invention can be made extremely simply, highly precisely and efficiently not by the skilled workers so that the dome can be constructed simply, efficiently and highly precisely Here, the connections of the frame member end portions to the joint blades of the joints can be made by means of bolts and nuts, or pins. In the fastening case using the bolts and nuts, no connection fault will occur if a torque wrench is used by checking its fastening force.

BRIEF DESCRIPTION OF DRAWINGS

FIG. 10(*b*) is a perspective view of another joint.

FIG. 11(*b*) is a partially enlarged sectional view of a roof portion in FIG. 11(*a*).

BEST MODE FOR CARRYING OUT THE INVENTION

A preferred embodiment of this invention will be described with reference to the accompanying drawings.

Figure 10A:
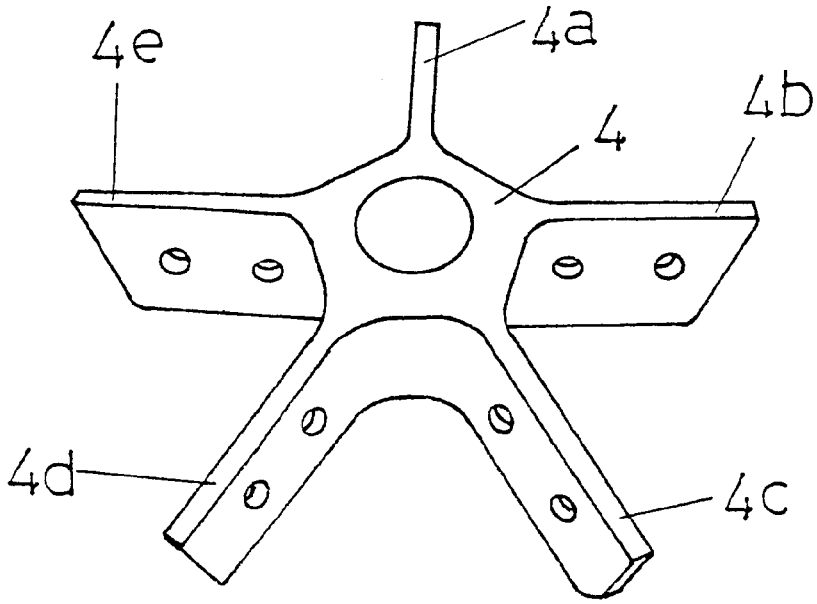
FIG. 10(*a*) is a perspective view of a joint to be used for assembling the polyhedral skeleton in the dome constructing method of this invention.
Figure 10B:
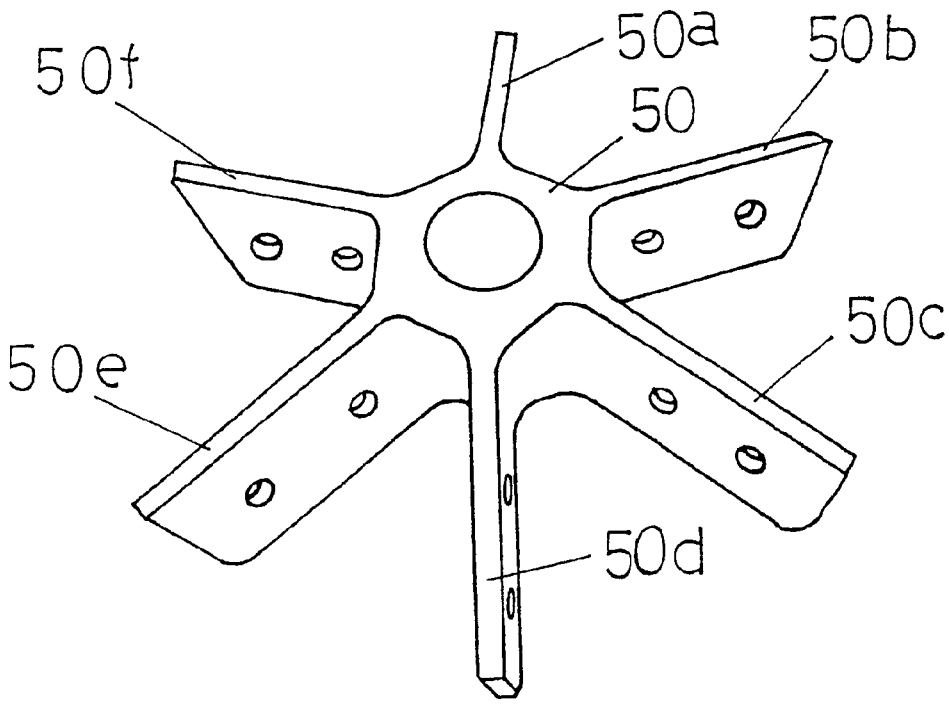

In this embodiment, there are used twelve joints 4 each providing with five joint blades 4*a* to 4*e*, as shown in FIG. 10(*a*), and twenty joints 50 each provided with six joint blades 50*a* to 50*f*, as shown in FIG. 10(*b*), to assemble a polyhedral skeleton 20 (FIG. 8) having sixty sides thereby to construct a spherical dome.

Figure 1:
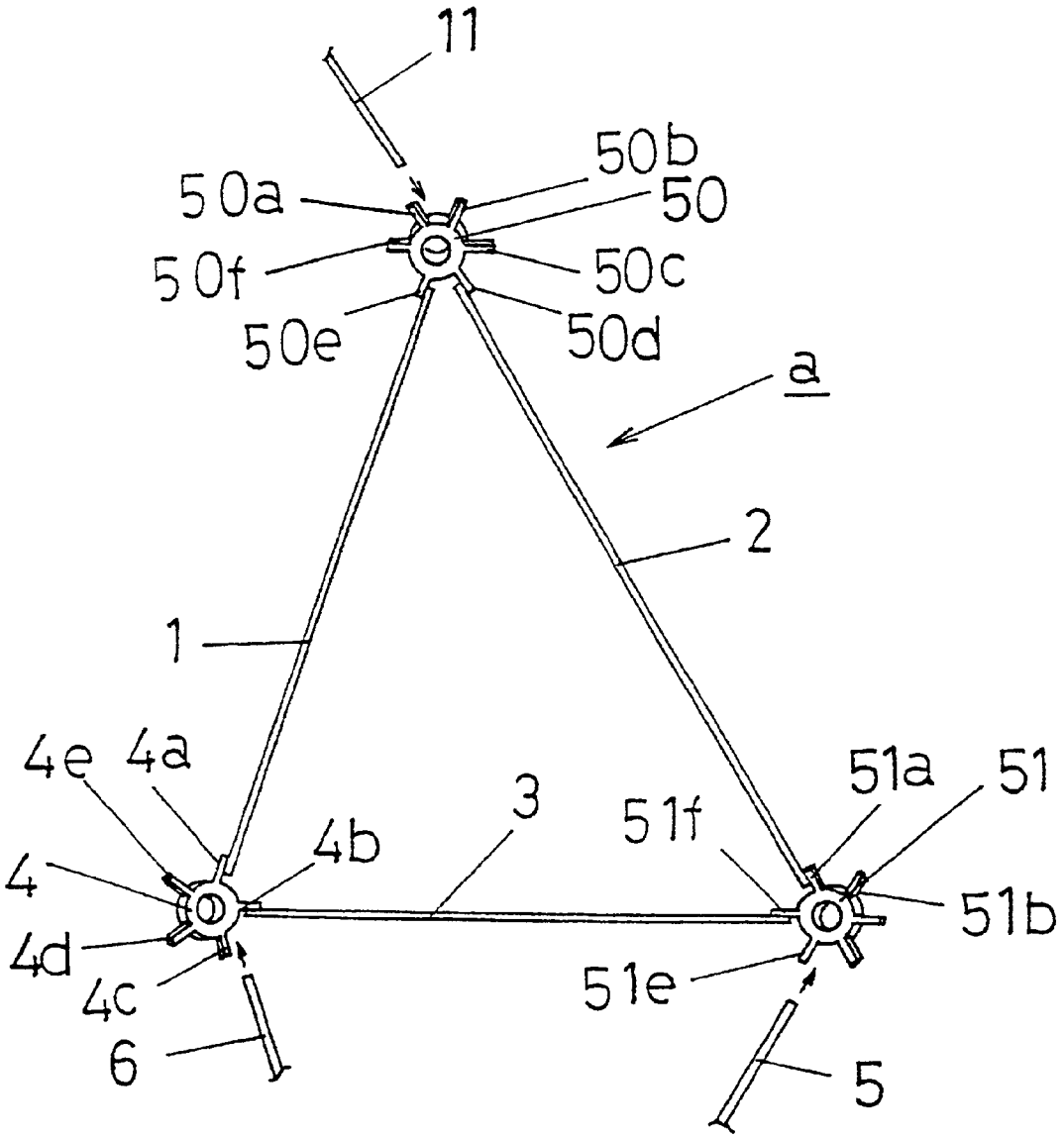
FIG. 1 is a top plan view for explaining a first assembled state of a triangular frame providing a basis for assembling a polyhedral skeleton for a dome construction.

On the ground, as shown in FIG. 1, frame members 1 and 3 are jointed at their one-end portions to the adjoining joint blades 4*a* and 4*b* of the joint 4. To the other one-end portions of the frame members 1 and 3, respectively, there are then jointed the joint blade 50*e* of the joint 50 and a joint blade 51*f* of a joint 51. Next, a frame member 2 is jointed at its two end portions individually to the joint blade 50*d* adjacent to the joint blade 50*e* of the joint 50 and to a joint blade 51*a* adjacent to the joint blade 51*f* of the joint 51. Thus, a first triangular frame a having its individual sides composed of the three frame members 1, 2 and 3 is so assembled (FIG. 1) that it is placed on the ground with its place being in parallel with the ground surface.

Here, the joint 4 having the five joint blades 4*a* to 4*e* is used as one of the vertexes of the first triangular frame a, whereas the joints 50 and 51 having the six joint blades 50*a* to 50*f* and 51*a* to 51*f* are used as the remaining two vertexes. As a result, the first triangular frame a is formed as the isosceles triangle having two sides of equal lengths composed of the frame members 1 and 3. In this embodiment for assembling the polyhedral skeleton having sixty sides, the joints 4 having the five joint blades and the joints 50 having the six joint blades are thus combined so that the triangular frames to be constructed are all the isosceles triangles.

Therefore, what has to be prepared is the two kinds of frame members, that is, the frame members having the length of the frame members 1 and 3, and the frame members having the length of the frame member 2 so that the cost for the materials can be lowered to reduce the cost for the dome construction.

Where a polyhedral skeleton of a regular icosahedron is assembled for the spherical dome construction by using the twelve joints 4 having the five joint blades, as shown in FIG. 10(*a*), the triangular frame as the fundamental unit for the polyhedral skeleton is a regular triangle so that what has to be prepared is only one kind of frame members of equal lengths.

To at least one of the three joins 4, 50 and 51, i.e., to the joint blades 4*c*, 4*d* and 4*e* of the joint 4 in this embodiment, there are respectively jointed one-end sides of frame members 6, 8 and 10. At the same time, the joint blades of joints 52, 53 and 54 are jointed to the other end sides of the frame members 6, 8 and 10, respectively, to assemble a polyhedral cone skeleton A (FIG. 2) which is formed of a polyhedron having the joint 4 as its vertex and a side number of the number (i.e., five) of the joint blades of the joint 4 and which contains the side formed of the aforementioned first triangular frame a as its one side. Here, the joint 4 is provided with the five joint blades 4*a* to 4*e* so that the polyhedral cone skeleton A is a skeleton of pentagonal cone.

Figure 2:
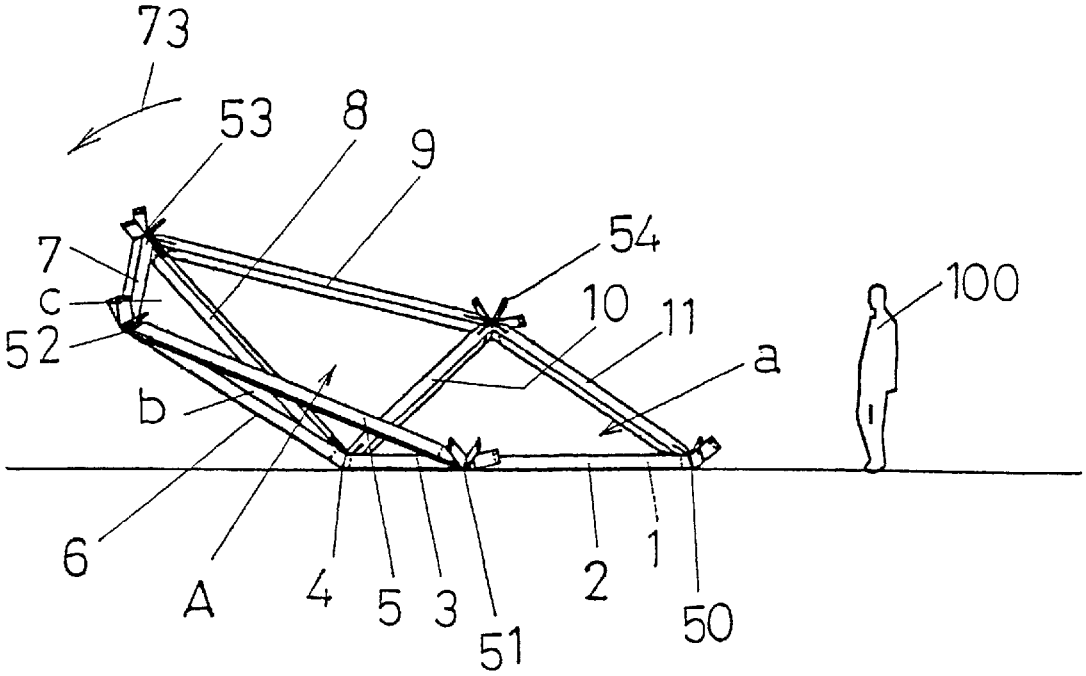
FIG. 2 is a side elevation of the state in which there is assembled a polyhedral skeleton (or a pentagonal cone skeleton) using a joint 4 of the triangular skeleton shown in FIG. 1 as its vertex.

At this time, frame members 5, 7, 9 and 11 could be jointed to the joints 51, 52, 53, 54 and 50, as shown in FIG. 2, to provide the polyhedral cone skeleton A of the pentagonal cone with its individual bases. In either event, a worker, as designated by 100 in FIG. 2, is enabled to do those works merely by preparing a relatively low scaffold.

Next, to the joint blades of the joint 50 other than the joint blades 50*e* and 50*d* located at the vertexes of the first triangular frame a and to the joint blades of the joint 51 other than the joint blades 51*a* and 51*f*, there are individually jointed frame members, to the other end sides of which there are jointed joints 55, 56, 57, 58 and 59 (FIG. 3), respectively. Then, the joints 50 and 51 have the six joint blades so that polyhedral cone skeletons B and C, which are assembled to have the joints 50 and 51 as their vertexes and which contain the side formed of the first triangular frame a as their one side, have the skeleton of a hexagonal cone (FIG. 3).

Figure 3:
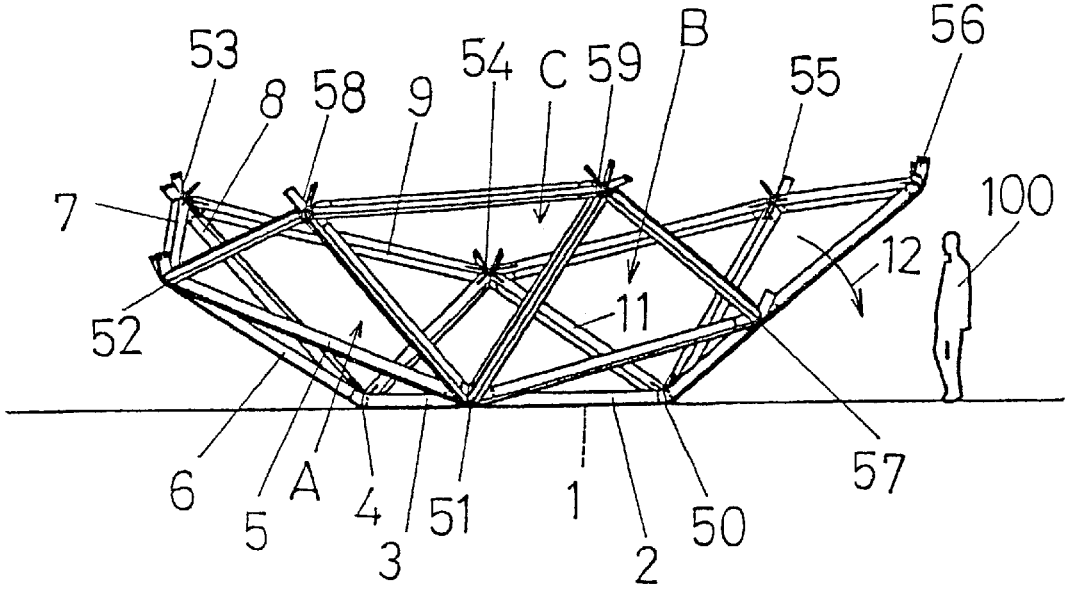
FIG. 3 is a side elevation of the state in which there is assembled a polyhedral skeleton using joints 50 and 51 of the triangular frame shown in FIG. 1 as their vertexes.
Figure 4:
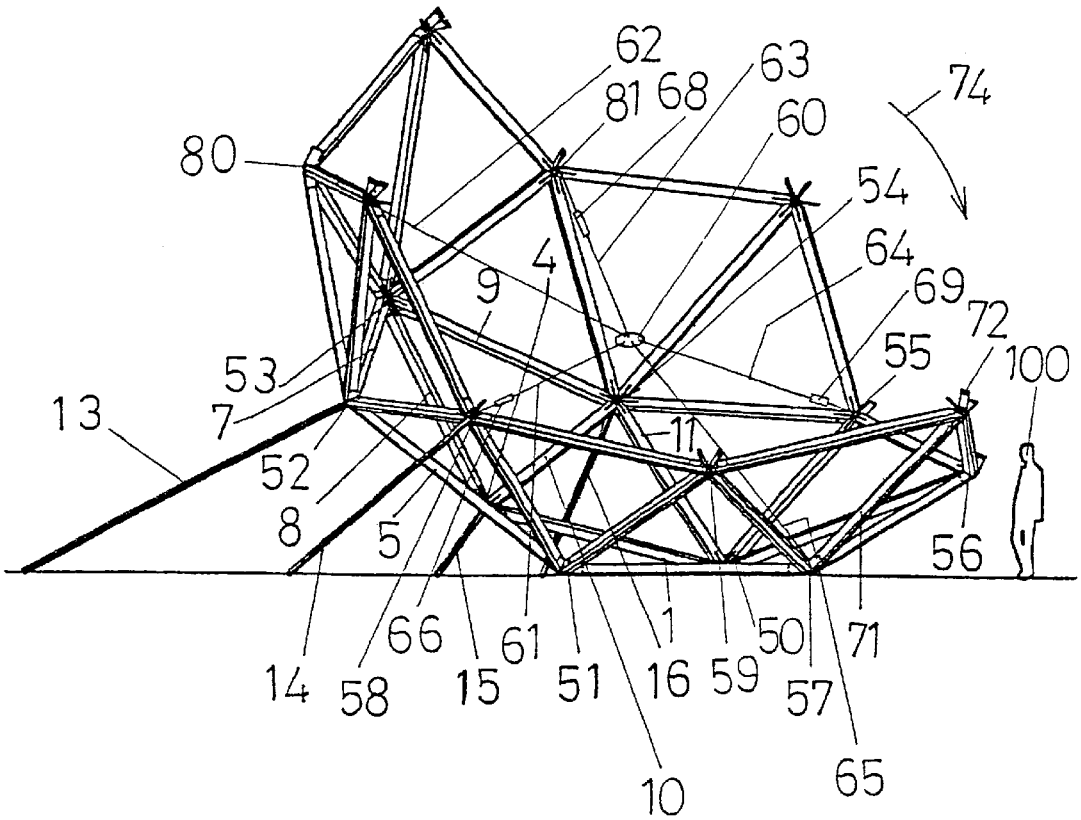
FIG. 4 is a side elevation of the state in which there is assembled a polyhedral skeleton using a joint 57 of the triangular skeleton as its vertex, as turned from the state of FIG. 3 to ground newly.

Next, the polyhedral cone skeleton B is turned, as indicated by arrow 12 in FIG. 3, so that the triangular frames other than the first triangular frame a may be so grounded into the state shown in FIG. 4 as to arrange their sides in parallel with the ground. In FIG. 4, the triangular frame having the joints 57, 50 and 51 at its vertexes is grounded. To at least one of the three joints located at the vertexes of the grounded triangular frame, i.e., to the individual joint blades of the joint 57 in FIG. 4, moreover, there are jointed the individual one-end sides of the frame members, to the individual other-end sides of which there are connected the joint blades of the remaining joints. Of the joint blades of the joint 57, as shown in FIG. 4, there is only one joint blade that has failed to be jointed to the frame member after the turn in the direction arrow 12 from the state shown in FIG. 3. To the remaining joint blade, there is connected one end side of a frame member 71, the other end side of which is jointed the joint blade of a joint 72 (FIG. 4).

Thus, there is assembled the polyhedral cone skeleton which has one joint 57 of the grounded triangular frame (i.e., the triangular frame having the joints 57, 50 and 51) as its vertex and has the number (six) of the joint blades of the joint 57 as its side number and which contains the side formed of the grounded triangular frame as its one side. In the example shown in FIG. 4, the joint 57 has the six joint blades so that the hexagonal cone skeleton is assembled.

In this skeleton assembling works, the polyhedral skeleton being assembled is desirably supported by posts 13, 14, 15 and 16, as shown in FIG. 4.

At the instant when the assembly is made in the state of FIG. 4, on the other hand, wires 61 to 65 are connected from a circular ring 60 through turnbuckles 66, 68, 69 and so on to joints 58, 80, 81, 55 and 57, respectively. These connections are effective for preventing the frame members from being deflected by their own weights in the procedure of constructing the polyhedral skeleton and for preventing the polyhedral skeleton being constructed from being collapsed. Especially where the frame members 1, 2, 3 and so on are relatively heavy because they are made of iron, it is preferable, for preventing the frame members from being deflected by their own weights in the procedure of constructing the polyhedral skeleton and the polyhedral skeleton being constructed from being collapsed, that the joints are tensed by the wires or the like toward the center of the polyhedral skeleton being assembled. The circular ring 60 and the joints 58 and so on are connected by the wires 61 and so on through the turnbuckles 66 and so on so that the distances from the circular ring 60 to the joints 58 and so on can be properly adjusted by adjusting the turnbuckles 66.

In order to pull the joints to the center of the polyhedral skeleton by the wires or the like, the works to connect the wires or the like to the joints may be done in the course of assembling the polyhedral skeleton at each time the arrangements of the joints 58, 80, 81, 55 and 57 shown in FIG. 4 are made. Here, these connected states of the joints by the wires are omitted from the subsequent assembling steps of FIGS. 5 to 8.

Figure 5:
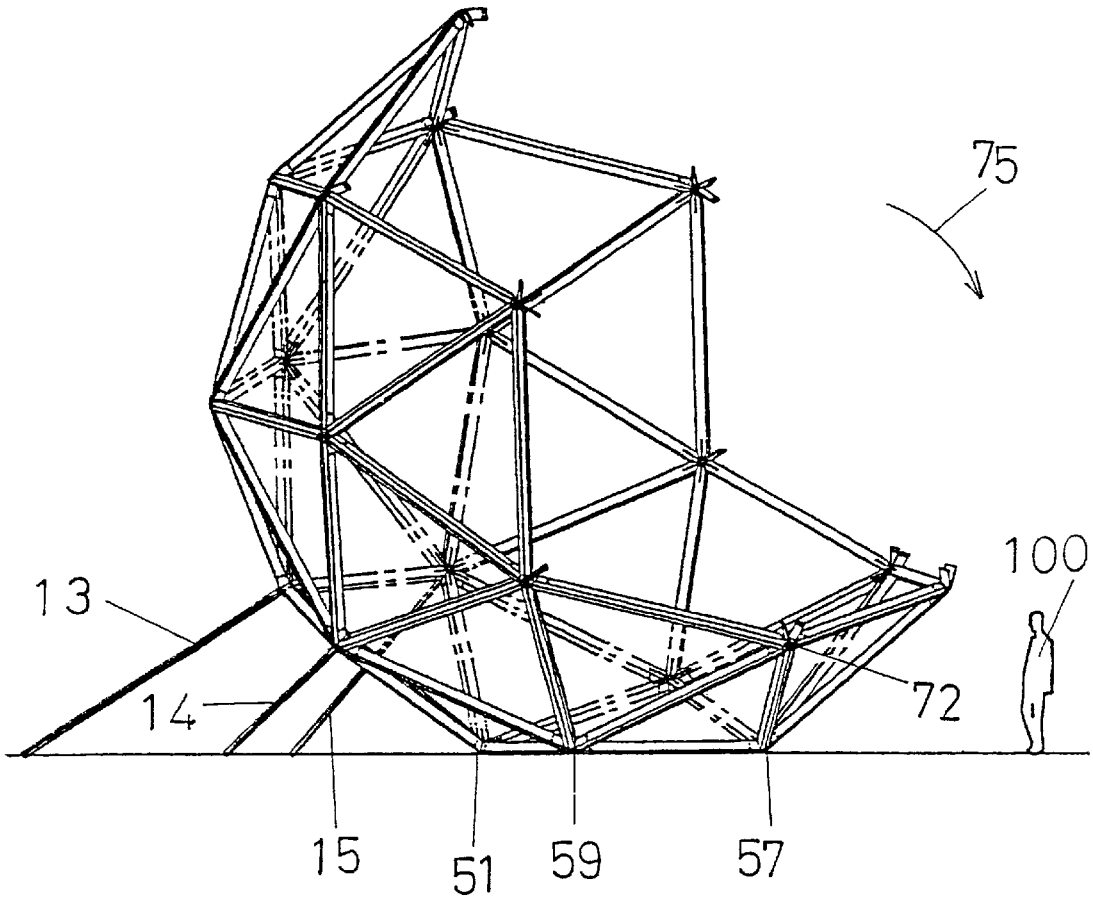
FIG. 5 is a side elevation of the state in which there is assembled a polyhedral skeleton using a joint 72 of the triangular skeleton, as turned from the state of FIG. 4 to ground newly as its vertex, by returning it from the state of FIG. 4 to ground newly, and in which the assembly of a polyhedral skeleton 20 has proceeded by about 40%.

Next, the polyhedral skeleton thus assembled to the stage of FIG. 4 is turned, as indicated by arrow 74 in FIG. 4, to ground the triangular frame having the joints 51, 59 and 57 at its vertexes (FIG. 5). Frame members are jointed to the joint blades of the joint 59 with any frame member jointed thereto, to assemble the polyhedral cone skeleton which has the joint 59 as its vertex and the number (six) of the joint blades of the joint 49 as its side number and which contains the side formed of said grounded triangular frame as its one side.

Next, the polyhedral skeleton thus assembled to the stage of FIG. 5 is turned, as indicated by arrow 75 in FIG. 5, to ground the triangular frame having the joints 57, 59 and 72 located at its vertexes (although not shown), and similar assembling works are continued.

In any event, the worker 100 can continue the assembling works always at the relatively low position, although the polyhedral skeleton for the dome construction is constructed gradually highly from the state of FIG. 2 to the state of FIG. 5.

In the description thus far made, after the assembly of the skeleton proceeded to the state shown in FIG. 3, the polyhedral cone skeleton is turned in the direction of arrow 12 to continue the assembly. The skeleton assembling procedure may be modified without any difference in the actions and effects of this invention. When the assembly of the skeleton proceeds to the state shown in FIG. 2, the polyhedral cone skeleton A is turned in the direction of arrow 73 (FIG. 2) to ground a triangular frame c formed of the frame members 6, 7 and 8, and the frame members are jointed to the joint blades of the joints 52 and 53 which are located at the vertexes of that triangular frame c.

Depending upon the conveniences of the scaffold built up for the works of the worker 100, polyhedral cone skeletons for the first floor, the second floor and the third floor can be assembled all at once and can then be turned to advance the assembly of a new polyhedral cone skeleton.

In any event, there is contained in this invention any of the constructing methods, in which there are sequentially advanced the works: to ground the triangular frame formed of the three frame members by turning the polyhedral skeleton (e.g., the pentagonal skeleton and the hexagonal skeleton) being assembled; and to joint the new frame members those joint blades of the joint located at the vertex of the newly grounded triangular frame, to which the frame members are not jointed yet, to assemble the polyhedral cone skeleton of the polygon, which has said joint as its vertex and the number of the joint blades of said joint as its side number and which contains the side formed of said newly grounded triangular frame as its one side.

Figure 6:
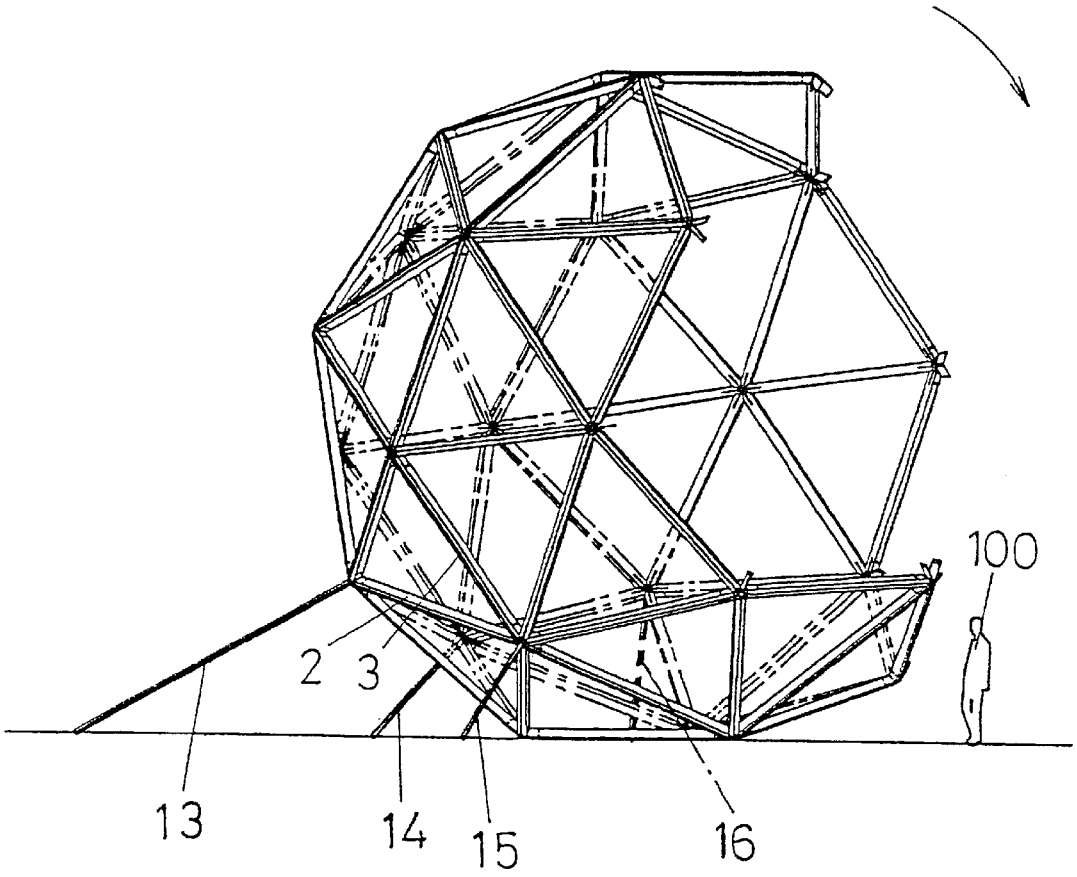
FIG. 6 is a side elevation of the state in which the assembly of the polyhedral skeleton 20 has been advanced by about 50% by turning it from the state shown in FIG. 5.
Figure 7:
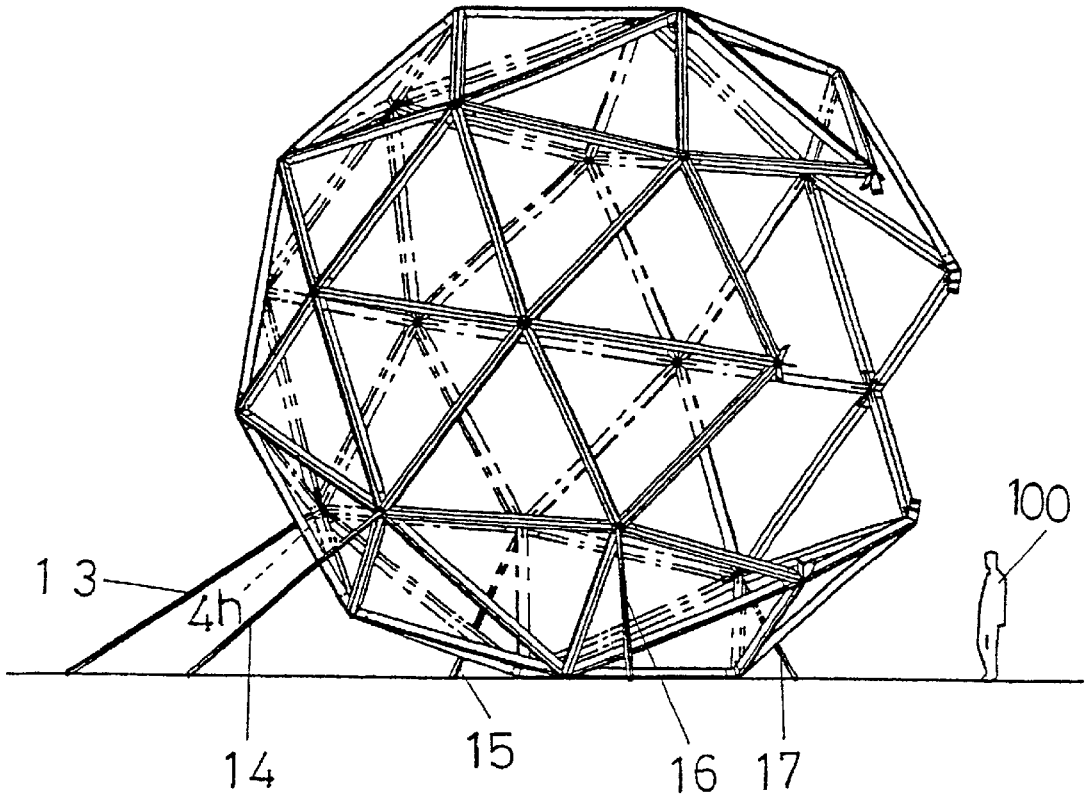
FIG. 7 is a side elevation of the state in which the assembly of the polyhedral skeleton 20 has been advanced by about 80% by turning it from the state shown in FIG. 6.

In the accompanying drawings: FIG. 5 shows the state having completed 40% of the assembly; FIG. 6 shows a 50% completion; FIG. 7 shows an 80% completion; and FIG. 8 shows the polyhedral skeleton 20 (e.g., the polyhedron having sixty sides in this embodiment) at the assembled time.

In or after the state shown in FIG. 7, a post 17 is used in addition to the posts 13, 14, 15 and 16 so as to support the polyhedral skeleton being assembled, more firmly.

By thus supporting the polyhedral skeleton firmly by the posts 13 or the like, the polyhedral skeleton can be stably placed even if an earthquake occurs or an unexpected external force is applied to the polyhedral skeleton being assembled.

Figure 8:
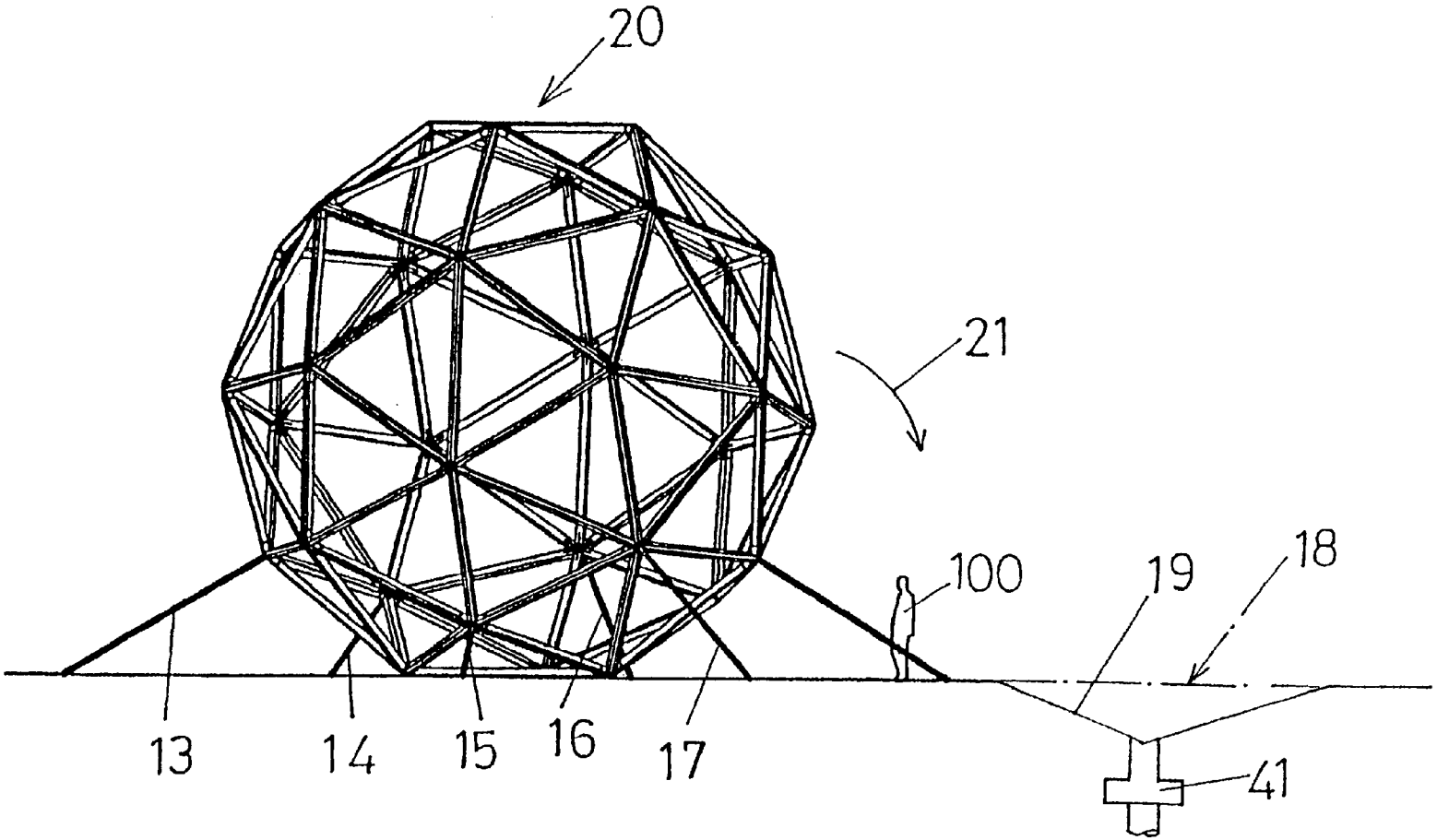
FIG. 8 is a side elevation of the state in which the assembly of the polyhedral skeleton 20 is completed.

The polyhedral skeleton 20, as assembled in the state of FIG. 8, can be finished, after fixed on the foundation, in its interior and exterior works to complete the spherical dome.

For example, the polyhedral skeleton 20 is placed on the dome building land which has been pre-worked for the foundation such as the driving of necessary piles or the placing of foundation slabs. After this, reinforcing bars are laid over the triangular frame grounded, and concrete is placed over the reinforcing bars to construct the foundation of the dome. After this, the polyhedral skeleton 20 can be interiorly or exteriorly finished to complete the spherical dome.

For this interior/exterior finish, the scaffold has to be constructed, and the triangular frame or the basic unit of the polyhedral skeleton 20 can be used for supporting the scaffold. If the polyhedral skeleton 20 is worked from its upper portion, for example, the triangular frame or the basic unit of the polyhedral skeleton 20, i.e., the lower triangular frame can be used to the last as the post of the scaffold. As a result, it is possible not only to spare the material but also to enhance the strength reliability so that the works can be executed without anxiety.

When the polyhedral skeleton 20 is to be moved so that it may be fixed on the foundation, it can be moved either by turning it or by suspending it by a crane or the like. As a result, it is possible to advance the dome constructing works lightly and highly efficiently.

Figure 9:
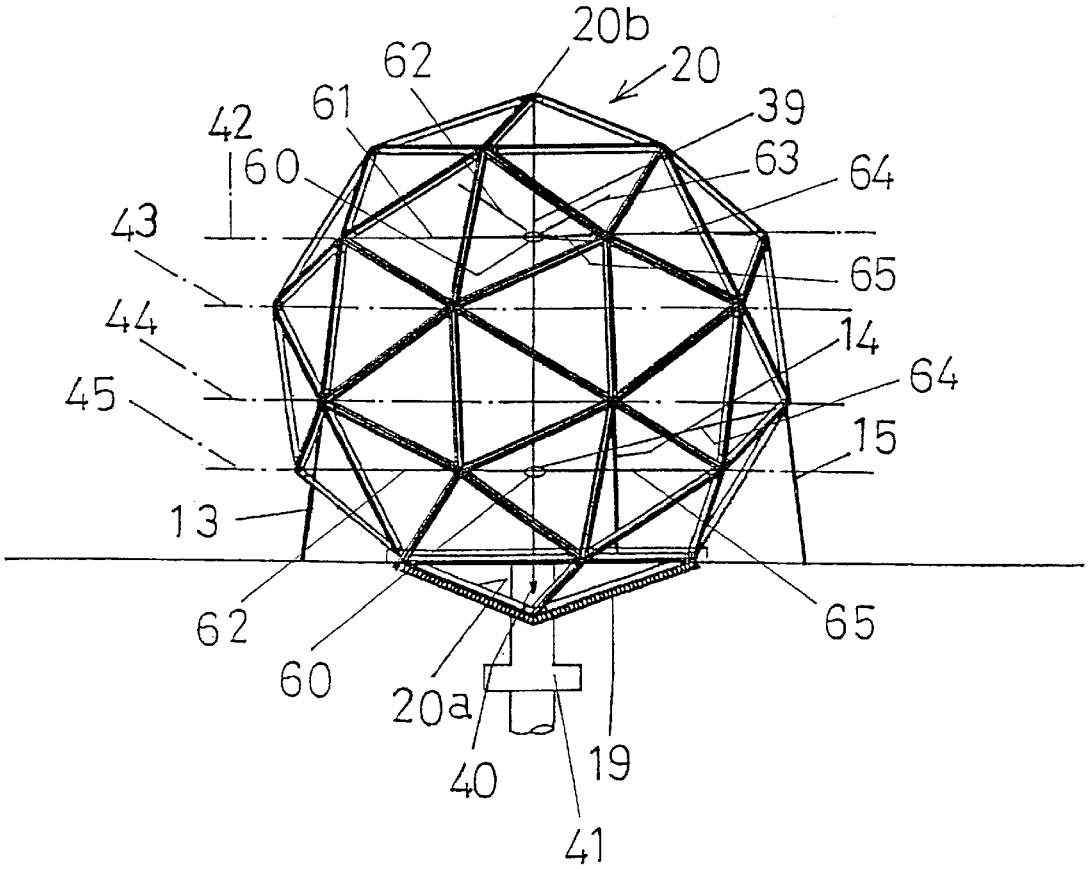
FIG. 9 is a partially sectional side elevation of the state in which the polyhedral skeleton 20 is placed in a hole excavated in a ground scheduled for the dome construction.

FIGS. 8 and 9 show one embodiment in which the spherical dome is completed by fixing the polyhedral skeleton 20 on the foundation and then by finishing its interior/exterior works. The polyhedral skeleton 20 is placed in a hole 19 excavated in a land scheduled for building the dome, and is fixed on the foundation. After this, the polyhedral skeleton 20 is interiorly or exteriorly finished to complete the spherical dome.

Specifically, the hole 19 is excavated in the dome-scheduled land 18, and an anchor 41 is driven to work the ground. Next, the polyhedral skeleton 20 is placed in the hole 19 by turning it in the direction of arrow 21 in FIG. 8.

Here, a weight 40 is suspended with a snapping line 39 from the crest 20*b* of the polyhedral skeleton 20, to determine the vertical line with respect to horizontal lines, as designated by reference numerals 42, 43, 44 and 45 for floor faces thereby to position the floor face 42 and so on horizontally. Next, the reinforcing bars are laid over the grounded skeleton 20*a* of the polyhedral skeleton 20, and the concrete is placed to bury the reinforcing bars thereby to fix the polyhedral skeleton 20.

After this, the polyhedral skeleton 20 is interiorly or exteriorly finished to complete the spherical dome.

Figures 11A, 11B:
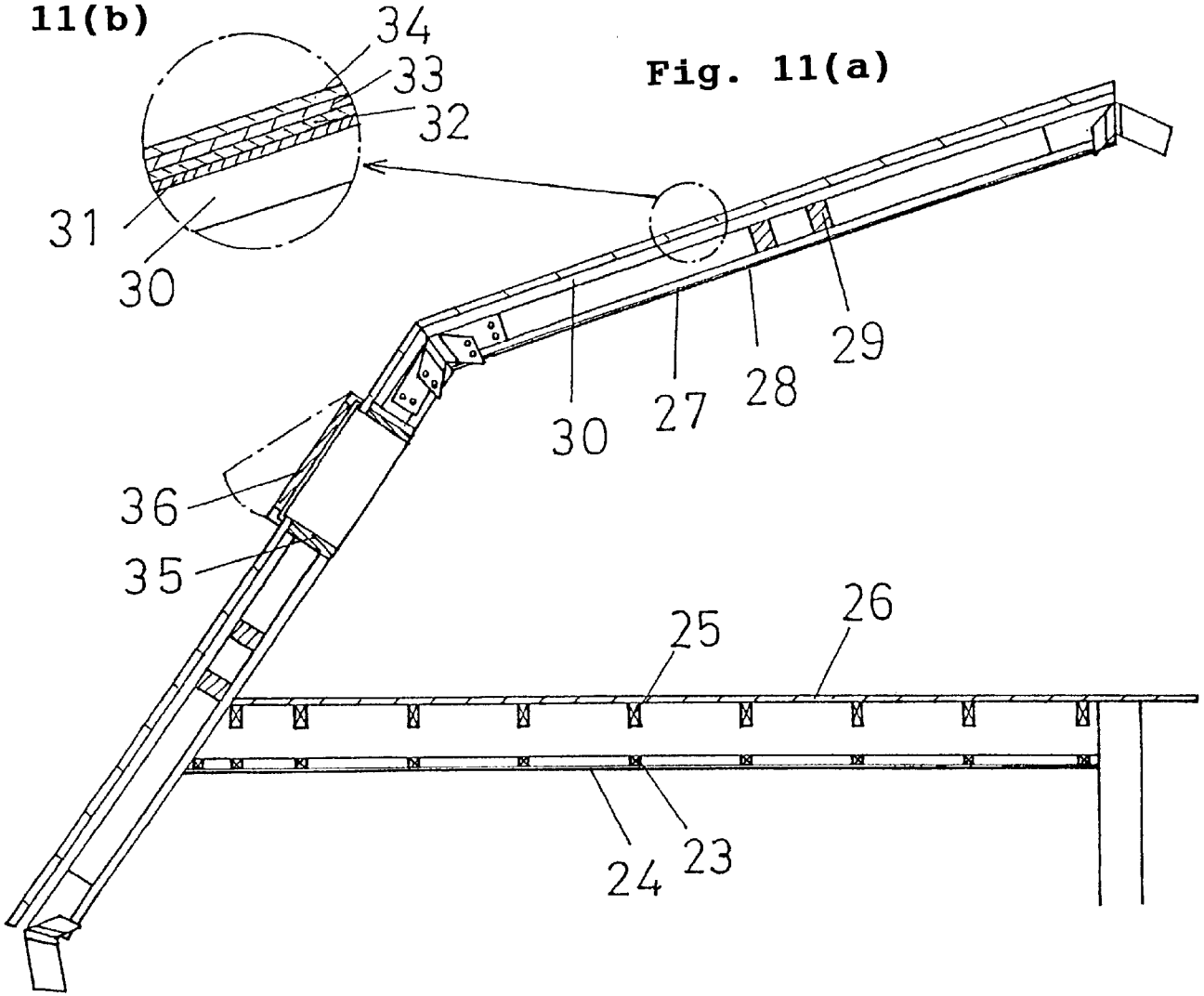
FIG. 11(*a*) is a partially enlarged sectional view of the interior/exterior finish works of the dome.

FIGS. 11(*a*) and 11(*b*) show one example of the interior/exterior finishes of a timber structure. The scaffold is constructed from the bottom. Joists 23 are crossed, and a ceiling member 24 is applied. Joists 25 are crossed, and a floor member 26 is applied. For the interior finish, a joist 27 is disposed in the triangular frame or the basic unit of the polyhedral skeleton 20, and a ceiling member 28 is applied. This ceiling member 28 is lined with a wall member. For the exterior finish, a common rafter 30 is fixed on the outer side of a frame 29. The exterior finish can be completed by laminating a roof board 31, an insulator 32, a waterproofer 33 and a roof member 34 on the outer side of the common rafter 30.

At a suitable position of the triangular frame or the basic unit of the polyhedral skeleton 20, on the other hand, a window frame 35 can be placed to attach a glass window 36 on the outer side thereof (FIG. 11(*a*)). The glass window 36 can be automatically opened/closed by an electric drive, for example.

In FIG. 9, there are shown the wires 61 to 65 and so on, which are connected from the circular ring 60, as disposed at the state shown in FIG. 4, to the joints disposed at the individual vertexes of the horizontal height portions designated by the numerals 42 and 45 for the floor faces. Those wires are provided for preventing the frame members, when made to have a relatively large weight, from being deflected by their own weights and for preventing the polyhedral skeleton being constructed from being collapsed. The wires are removed in the procedure of finishing the interior/exterior of the polyhedral skeleton 20. In this embodiment, the connections of the joints at the individual vertex portions to the center of the polyhedral skeleton are desirably made in at least two portions of the height portions of the horizontal lines, as indicated by numerals 42,43, 44 and 45.

Here, the construction method for fixing the polyhedral skeleton 20 having a plurality of joints as its individual vertexes and a plurality of frame members as its individual sides, after having assembled the polyhedral skeleton 20 can employ not only those having been described herein with reference to the drawings but also the various methods known in the art. In any of the methods, when the polyhedral skeleton 20 is moved so that it may be fixed on the foundation, it can be moved by turning it or by suspending it by a crane or the like so that the dome constructing works can be advanced lightly and highly efficiently.

What is claimed is:

1. A dome constructing method for constructing a spherical dome by assembling a polyhedral skeleton and then by finishing an interior part and an exterior part of the dome, the method comprising the steps of:

preparing a plurality of joints, each having a plurality of joint blades and preparing a plurality of frame members as members for constructing the polyhedral skeleton of the spherical dome, assembling three of the joints and three of the frame members into a first triangular frame of the polyhedral skeleton in a grounded state by using the three joints as the vertexes and the three frame members as the individual sides of the triangular frame, assembling a second triangular frame around said first triangular frame by using similar frame members and joints, the second triangular frame sharing one common frame member and two common joints with the first triangular frame, turning said polyhedral skeleton so that the second triangular frame is placed in the grounded state, continuing assembling the triangular frame until the polyhedral skeleton is completed, fixing the completed polyhedral skeleton in the grounded state, and forming the interior part and the exterior part onto the completed polyhedral skeleton to complete the spherical dome.

2. A dome constructing method for constructing a spherical dome by assembling a polyhedral skeleton by using a plurality of frame members and joints, each joint has a plurality of joint blades, and then by finishing an interior part and an exterior part of the dome, comprising the steps of:

(1) assembling a first triangular frame having three frame members being in parallel with the ground surface, by using three joints as vertexes and three frame members as sides of the first triangular frame;

(2) assembling a polyhedral cone skeleton formed by the first triangular frame and a second triangular frame, the second triangular frame sharing one common side and two common vertexes with the first triangular frame;

(3) turning the polyhedral cone skeleton assembled at said step (2) so that the second triangular frame is in parallel with the ground surface;

(4) continuing assembling the triangular frame until the polyhedral skeleton is completed;

(5) fixing the completed polyhedral skeleton to the grounded surface; and (6) completing the spherical dome by fixing the skeleton of the assembled polyhedron on the foundation and then forming the interior part and the exterior part onto the completed polyhedral skeleton.

3. A dome constructing method as set forth in claim 1, characterized in that the joint blades of the joint are four to six.

4. A dome constructing method as set forth in claim 2, characterized in that the joint blades of the joint are four to six.

5. A method for constructing a polyhedral skeleton for a spherical dome, the polyhedral skeleton having a plurality of surfaces, wherein each surface is a triangular frame having three sides in equal length and three vertexes, wherein all the vertexes of the triangular frames are located on one sphere, the method comprising the steps of:

preparing a plurality of frame members having equal length and a plurality of joints;

assembling three of the joints and three of the frame members into a first triangular frame of the polyhedral skeleton by using the three joints as the vertexes and the three frame members as the sides of the triangular frame;

forming a second triangular frame of the polyhedral skeleton by assembling the frame members and the vertexes, the second triangular frame sharing one common frame member and two common joints with the first triangular frame; and continuing forming new triangular frames by assembling the frame members and the joints, until the polyhedral skeleton is completed, wherein the polyhedral skeleton is rotated to facilitate the assembling of the frame members and the joints, so that each of the frame members and the joints can be assembled by using a short scaffold.

6. The method as recited by claim 5, wherein the polyhedral skeleton is rotated in such a way that a selected triangular frame is placed onto the ground surface, the selected triangular frame being closest to the frame members or joints next to be assembled.

7. The method as recited by claim 5, wherein the length of the scafford is smaller than the length of the frame members.

8. The method as recited by claim 5, wherein each of the joints has a plurality of joint blades extending in a fixed direction so that when a joint is assembled to a vertex of the polyhedral skeleton, the joint blades of said joint are adapted to fit onto the sides extending from said vertex.

9. The method as recited by claim 5, wherein each of the joints has a fixed number of joint blades, said fixed number is between four to six.

* * * * *